US006234598B1

(12) United States Patent
Torgerson et al.

(10) Patent No.: US 6,234,598 B1
(45) Date of Patent: May 22, 2001

(54) SHARED MULTIPLE TERMINAL GROUND RETURNS FOR AN INKJET PRINTHEAD

(75) Inventors: Joseph M. Torgerson, Philomath; Rama Prasad, Albany; Todd A. Cleland, Corvallis; Dale R. Oughton, Albany, all of OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/386,574

(22) Filed: Aug. 30, 1999

(51) Int. Cl.[7] ..... B41J 29/38; B41J 2/155; B41J 2/05

(52) U.S. Cl. ..... 347/13; 347/42; 347/57

(58) Field of Search ..... 347/57–59, 13, 347/42, 180, 181

(56) References Cited

U.S. PATENT DOCUMENTS

| | | | |
|---|---|---|---|
| 4,514,741 | 4/1985 | Meyer | 347/62 |
| 4,812,859 | 3/1989 | Chan et al. | 347/63 |
| 4,887,098 | 12/1989 | Hawkins et al. | 347/58 |
| 4,963,897 | 10/1990 | Kattner | 347/49 |
| 5,006,864 | 4/1991 | Ayata et al. | 346/33 R |
| 5,030,971 | 7/1991 | Drake et al. | 347/51 |
| 5,103,246 | 4/1992 | Dunn | 347/58 |
| 5,144,336 | 9/1992 | Yeung | 347/209 |
| 5,187,500 * | 2/1993 | Bohorquez et al. | 347/57 |
| 5,212,503 | 5/1993 | Saito et al. | 347/59 |
| 5,281,980 * | 1/1994 | Kishida et al. | 347/57 |
| 5,357,081 | 10/1994 | Bohorquez | 219/497 |
| 5,508,724 | 4/1996 | Boyd et al. | 347/58 |
| 5,541,629 | 7/1996 | Saunders et al. | 347/12 |
| 5,598,189 | 1/1997 | Hess et al. | 347/9 |
| 5,604,519 * | 2/1997 | Keefe et al. | 347/13 |
| 5,635,968 | 6/1997 | Bhaskar et al. | 347/59 |
| 5,638,101 | 6/1997 | Keefe et al. | 347/65 |
| 5,644,342 * | 7/1997 | Argyres | 347/57 |
| 5,808,640 | 9/1998 | Bhaskar et al. | 347/58 |
| 5,835,112 | 11/1998 | Whitlock et al. | 347/50 |

* cited by examiner

*Primary Examiner*—John Barlow
*Assistant Examiner*—Juanita Stephens
(74) *Attorney, Agent, or Firm*—Raymond A. Jenski

(57) ABSTRACT

For an inkjet printing apparatus having a large number of ink ejectors, it is desirable to have as few as possible interconnections to the ink ejectors. Sharing electrical ground returns between related ink ejector primitive groups with spaced apart terminals provides a reduction in interconnections while offering redundancy in the interconnection.

20 Claims, 9 Drawing Sheets

SHARED MULTIPLE TERMINAL GROUND RETURNS FOR AN INKJET PRINTHEAD

BACKGROUND OF THE INVENTION

The present invention relates generally to inkjet printing devices, and more particularly to an inkjet printhead for thermal inkjet printing devices that reduces the number of interconnections providing electrical connection to the drop ejector heater resistors with out sacrificing reliability.

The art of inkjet printing technology is relatively well developed. Commercial products such as computer printers, graphics plotters, copiers, and facsimile machines successfully employ inkjet technology for producing hard copy printed output. The basics of the technology has been disclosed, for example, in various articles in the Hewlett-Packard Journal, Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No. 1 (February 1994) editions. Inkjet devices have also been described by W. J. Lloyd and H. T. Taub in Output Hardcopy Devices (R. C. Durbeck and S. Sherr, ed., Academic Press, San Diego, 1988, chapter 13).

A thermal inkjet printer for inkjet printing typically includes one or more translationally reciprocating print cartridges in which small drops of ink are ejected by a drop generator towards a medium upon which it is desired to place alphanumeric characters, graphics, or images. Such cartridges typically include a printhead having an orifice member or plate that has a plurality of small nozzles through which the ink drops are ejected. Beneath the nozzles are ink firing chambers, enclosures in which ink resides prior to ejection by an ink ejector through a nozzle. Ink is supplied to the ink firing chambers through ink channels that are in fluid communication with an ink reservoir, which may be contained in a reservoir portion of the print cartridge or in a separate ink container spaced apart from the printhead.

Ejection of an ink drop through a nozzle employed in a thermal inkjet printer is accomplished by quickly heating the volume of ink residing within the ink firing chamber with a selectively energizing electrical pulse to a heater resistor ink ejector positioned in the ink firing chamber. At the commencement of the heat energy output from the heater resistor, an ink vapor bubble nucleates at sites on the surface of the heater resistor or its protective layers. The rapid expansion of the ink vapor bubble forces the liquid ink through the nozzle. Once the electrical pulse ends and an ink drop is ejected, the ink firing chamber refills with ink from the ink channel and ink reservoir.

Following removal of electrical power from the heater resistor, the vapor bubble collapses in the firing chamber in a small but violent way. Components within the printhead in the vicinity of the vapor bubble collapse are susceptible to fluid mechanical stresses (cavitation) as the vapor bubble collapses, thereby allowing ink to crash into the ink firing chamber components. The heater resistor is particularly susceptible to damage from cavitation. One or more protective layers are typically disposed over the resistor and adjacent structures to protect the resistor from cavitation and from chemical attack by the ink. One protective layer in contact with the ink is a mechanically hard cavitation layer that provides protection from the cavitation wear of the collapsing ink. Another layer, a passivation layer, is typically placed between the cavitation layer and the heater resistor and its associated structures to provide protection from chemical attack. Thermal inkjet ink is chemically reactive, and prolonged exposure of the heater resistor and its electrical interconnections to the ink will result in a degradation and failure of the heater resistor and electrical conductors.

The heater resistors of a conventional inkjet printhead comprise a thin film resistive material disposed on an oxide layer of a semiconductor substrate. Electrical conductors are patterned onto the oxide layer and provide an electrical path to and from each thin film heater resistor. Since the number of electrical conductors can become large when a large number of heater resistors are employed in a high density (high DPI—dots per inch) printhead, various multiplexing techniques have been introduced to reduce the number of conductors needed to connect the heater resistors to circuitry disposed in the printer. See, for example, U.S. Pat. No. 5,541,629 "Printhead with Reduced Interconnections to a Printer" and U.S. Pat. No. 5,134,425, "Ohmic Heating Matrix". Each electrical conductor, despite its good conductivity, imparts an undesirable amount of resistance in the path of the heater resistor. This undesirable parasitic resistance uselessly dissipates a portion of the electrical energy which otherwise would be available to the heater resistor thereby wasting energy that could otherwise be employed in more efficiently ejecting ink drops. If the heater resistance is low, the magnitude of the current drawn to nucleate the ink vapor bubble will be relatively large resulting in the amount of energy wasted in the parasitic resistance of the electrical conductors being significant relative to that provided to the heater resistor. That is, if the ratio of resistances between that of the heater resistor and the parasitic resistance of the electrical conductors (and other components) is too small, the efficiency (and the temperature) of the printhead suffers with the wasted energy.

Most of the thermal inkjet printers available today use square heater resistors that have a resistance of 35 to 40 Ω. If it were possible to use resistors with higher values of resistance, the energy needed to nucleate an ink vapor bubble would be transmitted to the thin film heater resistor at a higher voltage and lower current. The energy wasted in the parasitic resistances would be reduced and the power supply that provides the power to the heater resistors could be made smaller and less expensive.

As users of inkjet printers have begun to desire finer detail in the printed output from a printer, the technology has been pushed into a higher resolution of ink drop placement on the medium. One of the common ways of measuring the resolution is the measurement of the maximum number of ink dots deposited in a selected dimension of the printed medium, commonly expressed as dots per-inch (DPI). The production of an increased DPI requires smaller drops. Smaller ink drops means a lowered drop weight and lowered drop volume for each drop. Production of low drop weight ink drops requires smaller structures in the printhead. So, designers of inkjet printheads are faced with the problem of more drop generators (with their associated heater resistors) disposed over a smaller area of printhead being operated at an increased frequency. In order to energize the greater number of smaller drop generators, an increased number of electrical conductors is required on a smaller area of printhead substrate real estate.

The aforementioned multiplexing techniques have helped reduce the total number of conductors necessary to energize the heater resistors. More improvement is needed, however, to reliably reach the high drop generator densities required for modern printing operations.

SUMMARY OF THE INVENTION

A printhead for an inkjet printer includes a substrate upon which is disposed a plurality of heater resistors. The heater resistors are electrically arranged into a first group and a second group. A first electrical conductor is disposed on the substrate, coupled to each heater resistor in the first group, and terminated in a first terminal disposed on the substrate. This allows electrical current to be sourced to each heater resistor in the first group. A second electrical conductor is disposed on the substrate, coupled to each heater resistor in the second group, and terminated in a second terminal disposed on the substrate. This allows electrical current to be sourced to each heater resistor in the second group. A third electrical conductor is disposed on the substrate, coupled to each heater resistor in both of the first group and the second group, and terminated in third and fourth terminals disposed spaced apart from each other on the substrate to return electrical current and complete an electrical circuit.

DETAILED DESCRIPTION OF A PREFERRED EMBODIMENT

In order to realize a reduced number of conductor traces and maintain reliability, the heater resistor supply current that is sourced to each primitive is returned via a common ground return conductor that utilizes several interconnection terminals on the semiconductor printhead substrate.

Figure 1A:
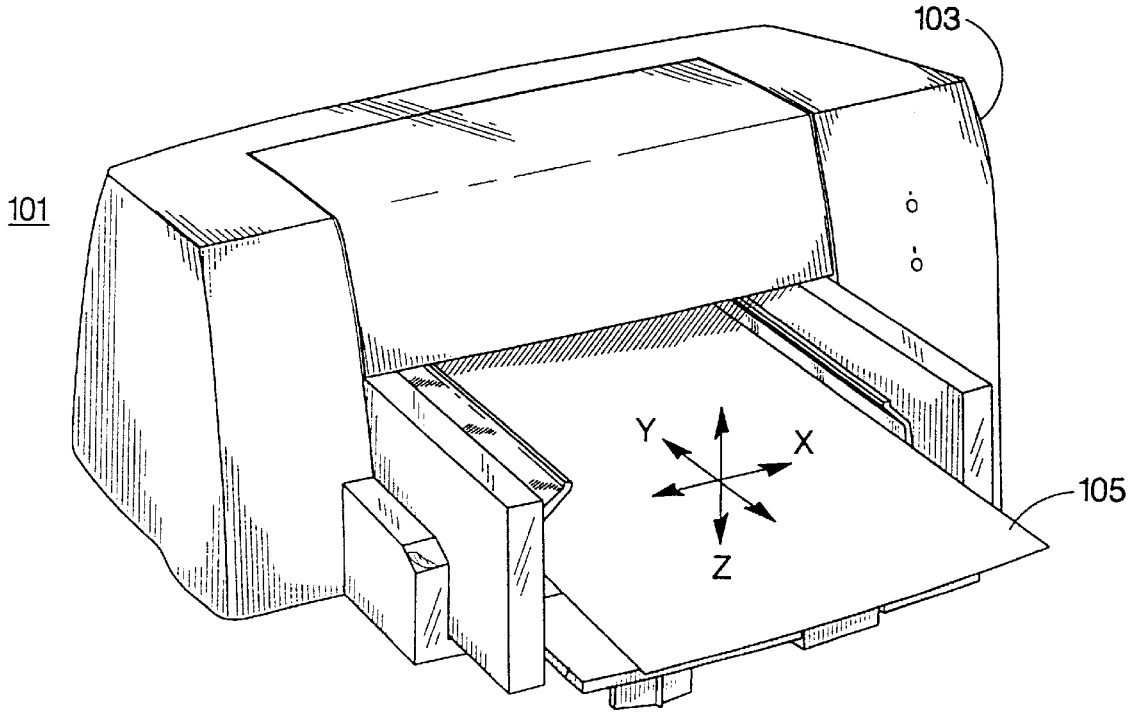
FIG. 1A is an isometric drawing of an exemplary printing apparatus which may employ the present invention.
Figure 1B:
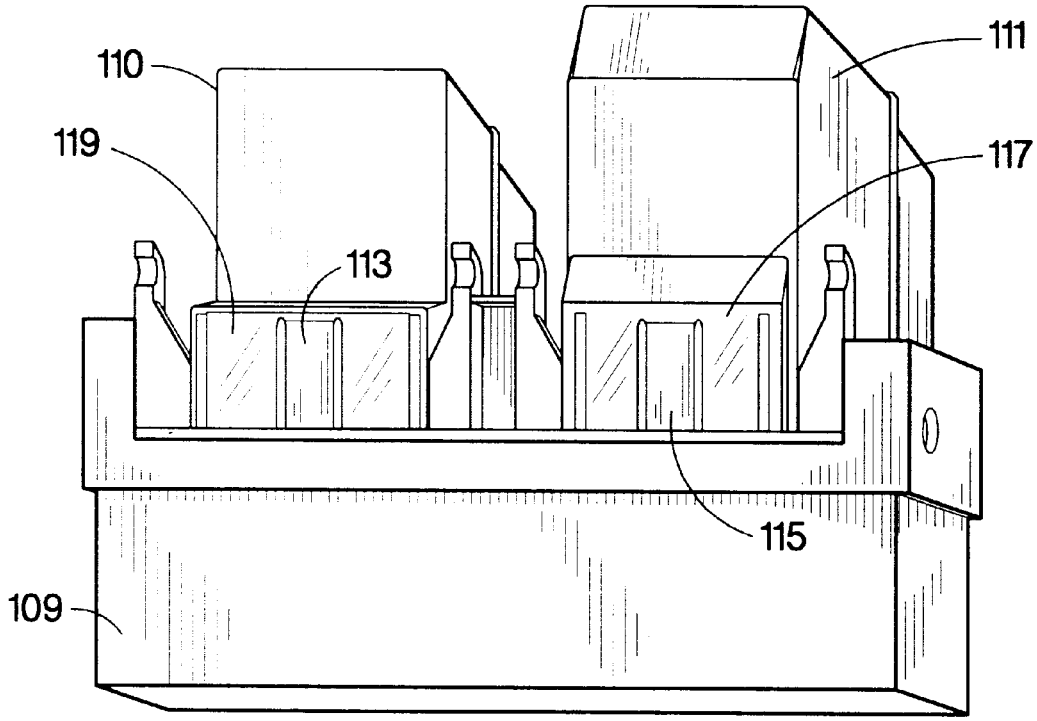
FIG. 1B is an isometric drawing of a print cartridge carriage apparatus which may be employed in the printing apparatus of FIG. 1A.

An exemplary inkjet printing apparatus, a printer 101, that may employ the present invention is shown in outline form in the isometric drawing of FIG. 1A. Printing devices such as graphics plotters, copiers, and facsimile machines may also profitably employ the present invention. A printer housing 103 contains a printing platen to which an input print medium 105, such as paper, is transported by mechanisms that are known in the art. A carriage within the printer 101 holds one or a set of individual print cartridges capable of ejecting ink drops of black or color ink. Alternative embodiments can include a semipermanent printhead mechanism that is sporadically replenished from one or more fluidically-coupled off-axis ink reservoirs, or a single print cartridge having two or more colors of ink available within the print cartridge and ink ejecting nozzles designated for each color, or a single color print cartridge or print mechanism; the present invention is applicable to a printhead employed by at least these alternatives. A carriage 109, which may be employed in the present invention and mounts two print cartridges 110 and 111, is illustrated in FIG. 1B. The carriage 109 is typically supported by a slide bar or similar mechanism within the printer and physically propelled along the slide bar to allow the carriage 109 to be translationally reciprocated or scanned back and forth across the print medium 105. The scan axis, X, is indicated by an arrow in FIG. 1B. As the carriage 109 scans, ink drops are selectively ejected from the printheads of the set of print cartridges 110 and 111 onto the medium 105 in predetermined print swath patterns, forming images or alphanumeric characters using dot matrix manipulation. Conventionally, the dot matrix manipulation is determined by a user's computer (not shown) and instructions are transmitted to a microprocessor-based, electronic controller within the printer 101. Other techniques of dot matrix manipulation are accomplished by the computer's rasterizing the data then sending the rasterized data as well as print commands to the printer. The printer interprets the commands and rasterized information to determine which drop generators to fire. The ink drop trajectory axis, Z, is indicated by an arrow. When a swath of print has been completed, the medium 105 is moved an appropriate distance along the print media axis, Y, indicated by an arrow, in preparation for the printing of the next swath. This invention is also applicable to inkjet printing apparatus employing alternative means of importing relative motion between printhead and media, such as those that have fixed printheads (such as page wide arrays) and move the media in one or more directions, those that have fixed media and move the printhead in one or more directions (such as flatbet plotters). In addition, this invention is applicable to a variety of printing systems, including large format devices, copiers, fax machines, photo printers, and the like.

The inkjet carriage 109 and print cartridges 110, 111 are shown from the −Z direction within the printer 101 in FIG. 1B. The printheads 113, 115 of each cartridge may be observed when the carriage and print cartridges are viewed from this direction. In a preferred embodiment, ink is stored in the body portion of each printhead 110, 115 and routed through internal passageways to the respective printhead. In an embodiment of the present invention which is adapted for multi-color printing, three groupings of orifices, one for each color (cyan, magenta, and yellow), is arranged on the foraminous orifice plate surface of the printhead 115. Ink is selectively expelled for each color under control of commands from the printer that are communicated to the printhead 115 through electrical connections and associated conductive traces (not shown) on a flexible polymer tape 117. In the preferred embodiment, the tape 117 is typically bent around an edge of the print cartridge as shown and secured. In a similar manner, a single color ink, black, is stored in the ink-containing portion of cartridge 110 and routed to a single grouping of orifices in printhead 113. Control signals are coupled to the printhead from the printer on conductive traces disposed on a polymer tape 119.

Figure 2:
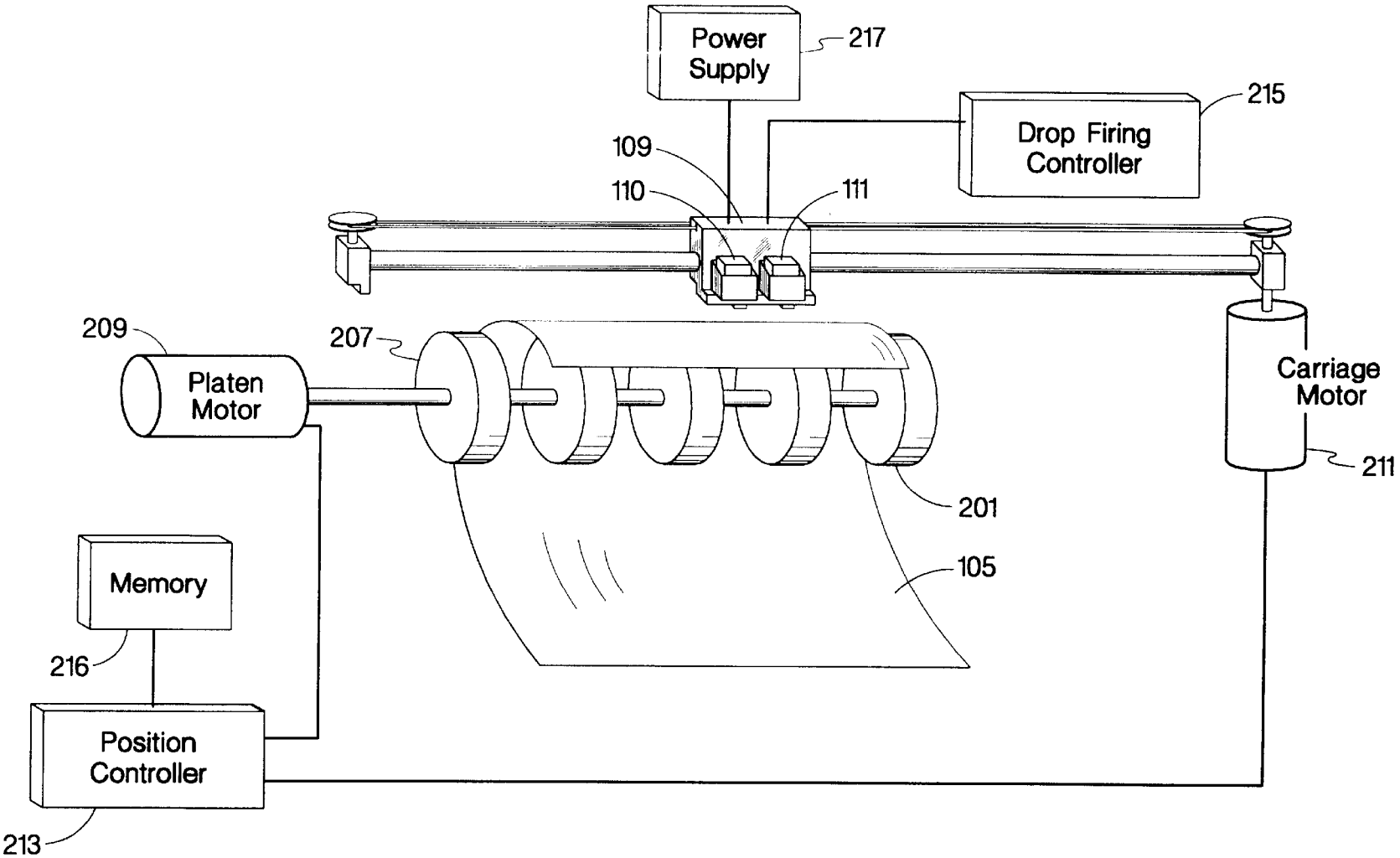
FIG. 2 is a schematic representation of the functional elements of the printer of FIG. 1A .

As can be appreciated from FIG. 2, a single medium sheet is advanced from an input tray into a printer print area beneath the printheads by a medium advancing mechanism including a roller 207, a platen motor 209, and traction devices (not shown). In a preferred embodiment, the inkjet print cartridges 110, 111 are incrementally drawn across the medium 105 on the platen by a carriage motor 211 in the ±X direction, perpendicular to the Y direction of entry of the medium. The platen motor 209 and the carriage motor 211 are typically under the control of a media and cartridge position controller 213. An example of such positioning and control apparatus may be found described in U.S. Pat. No. 5,070,410 "Apparatus and Method Using a Combined Read/Write Head for Processing and Storing Read Signals and for Providing Firing Signals to Thermally Actuated Ink Ejection Elements". Thus, the medium 105 is positioned in a location so that the print cartridges 110 and 111 may eject drops of ink to place dots on the medium as required by the data that is input to a drop firing controller 215 and power supply 217 of the printer. These dots of ink are formed from the ink drops expelled from selected orifices in the printhead in a band parallel to the scan direction as the print cartridges 110 and 111 are translated across the medium by the carriage motor 211. When the print cartridges 110 and 111 reach the end of their travel at an end of a print swath on the medium 105, the medium is conventionally incrementally advanced by the position controller 213 and the platen motor 209. Once the print cartridges have reached the end of their traverse in the X direction on the slide bar, they are either returned back along the support mechanism while continuing to print or returned without printing. The medium may be advanced by an incremental amount equivalent to the width of the ink ejecting portion of the printhead or some fraction thereof related to the spacing between the nozzles. Control of the medium, positioning of the print cartridge, and selection of the correct ink ejectors for creation of an ink image or character is determined by the position controller 213. The controller may be implemented in a conventional electronic hardware configuration and provided operating instructions from conventional memory 216. Once printing of the medium is complete, the medium is ejected into an output tray of the printer for user removal.

Figure 3:
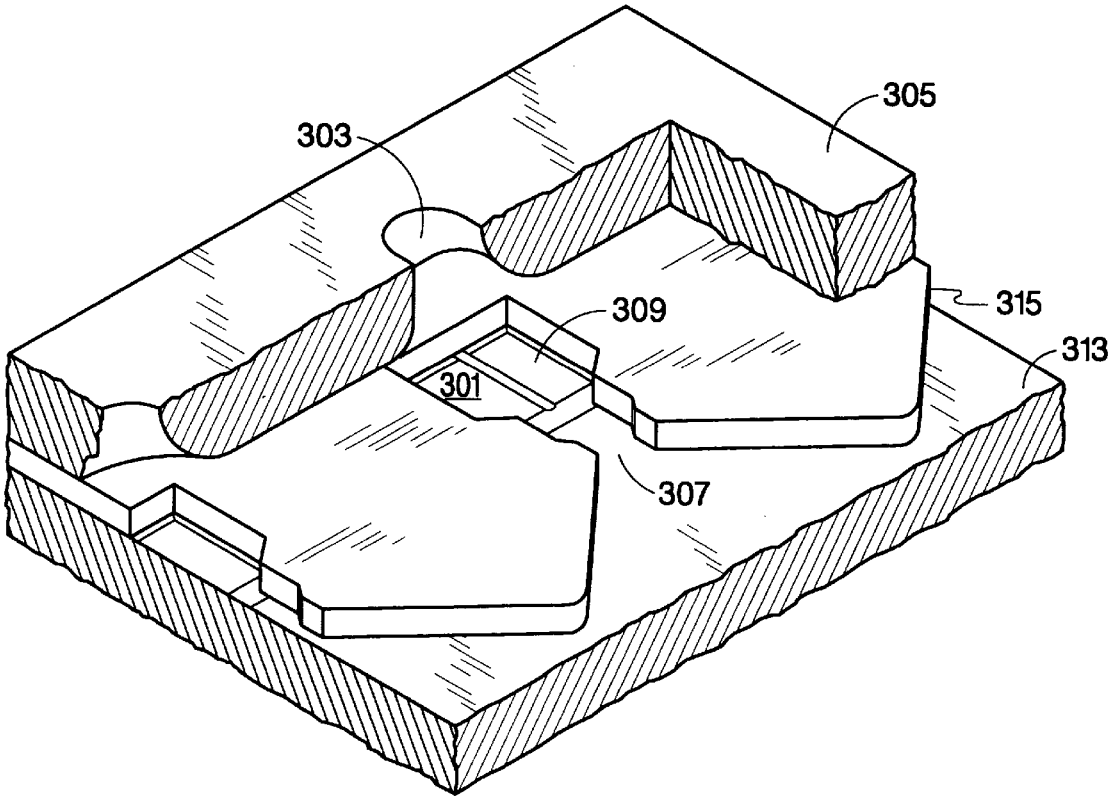
FIG. 3 is a magnified isometric cross section of a drop generator which may be employed in the print cartridge printhead of the printer of FIG. 1A.
Figure 5:
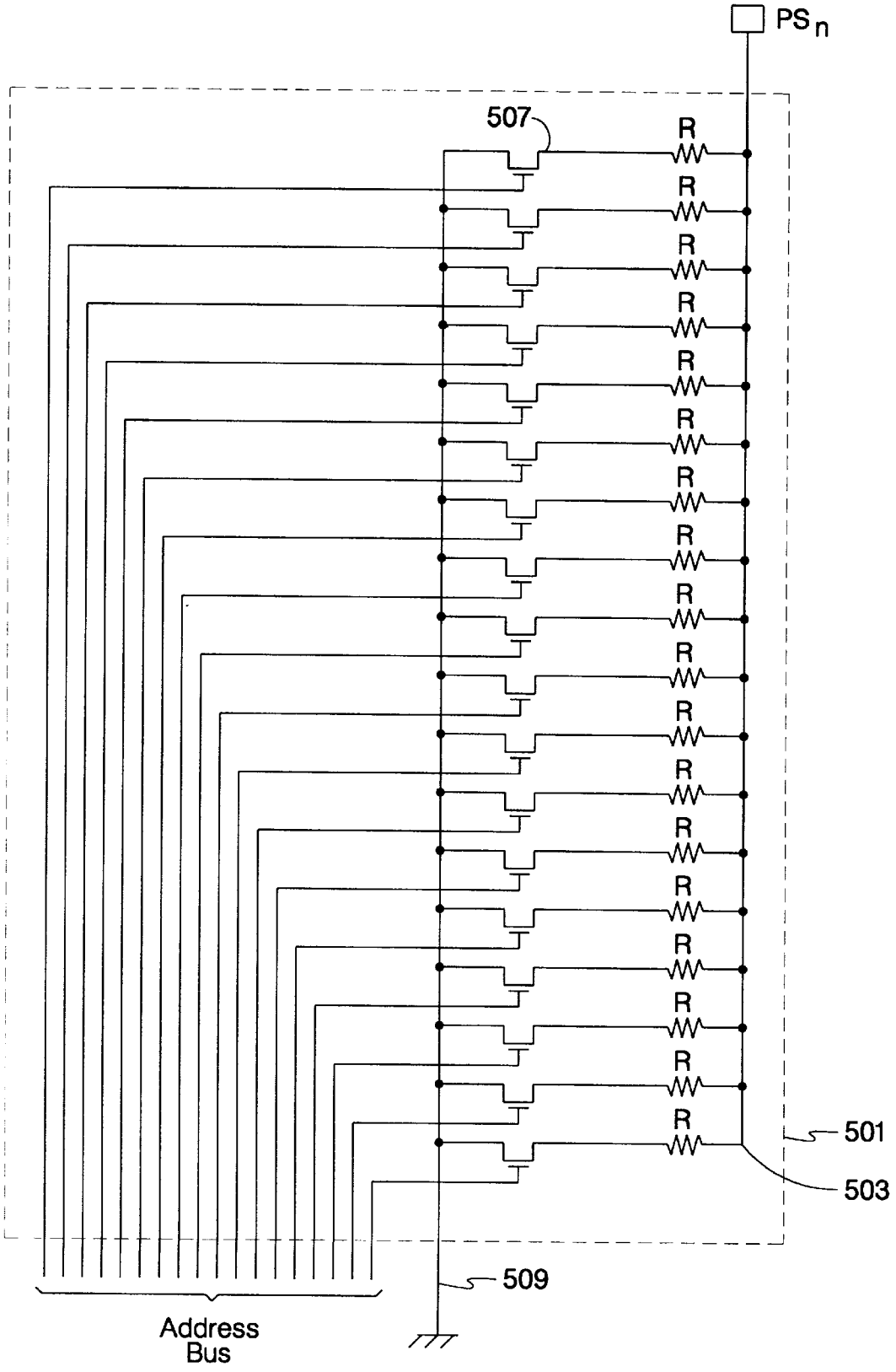
FIG. 5 is an electrical schematic of a printhead primitive which may be employed in the present invention.

A single example of an ink drop generator found within a printhead is illustrated in the magnified isometric cross section of FIG. 3. As depicted, the drop generator comprises a nozzle, a firing chamber, and an ink ejector. Alternative embodiments of a drop generator employ more than one coordinated nozzle, firing chamber, and/or ink ejectors The drop generator is fluidically coupled to a source of ink. The drop generator depicted in FIG. 3 includes a heater resistor 309. In a preferred embodiment, the heater resistor 309 has a resistance of at least 70 ohms to reduce parasitic power losses through leads that provide power to the resistor. In a preferred embodiment, the heater resistor has a resistance of about 140 ohms, measured from between pads on the print cartridge 110 or 111 that utilizes the heater resistor 309. This unconventionally high resistance, in contrast to the 30 to 40 ohms used in most conventional print cartridges, can be accomplished by reducing thickness or increasing resistivity of a thin film layer used for fabricating resistor 309. Alternatively, a segmented design can be used, as depicted in FIGS. 3 and 5 and discussed below.

In FIG. 3, a preferred embodiment of an ink firing chamber 301 is shown in correspondence with a nozzle 303 and a segmented heater resistor 309. Many independent nozzles are typically arranged in a predetermined pattern on the orifice plate 305 so that the ink drops are expelled in a controlled pattern. Generally, the medium is maintained in a position which is parallel to the plane of the external surface of the orifice plate. The heater resistors are selected for activation in a process that involves the data input from an external computer or other data source coupled to the printer in association with the drop firing controller 215 and power supply 217. Ink is supplied to the firing chamber 301 via opening 307 to replenish ink that has been expelled from orifice 303 following the creation of an ink vapor bubble by heat energy released from the segmented heater resistor 309. The ink firing chamber 301 is bounded by walls created by the orifice plate 305, a layered semiconductor substrate 313, and barrier layer 315. In a preferred embodiment, fluid ink stored in a reservoir of the cartridge housing flows by capillary force to fill the firing chamber 301.

Figure 4:
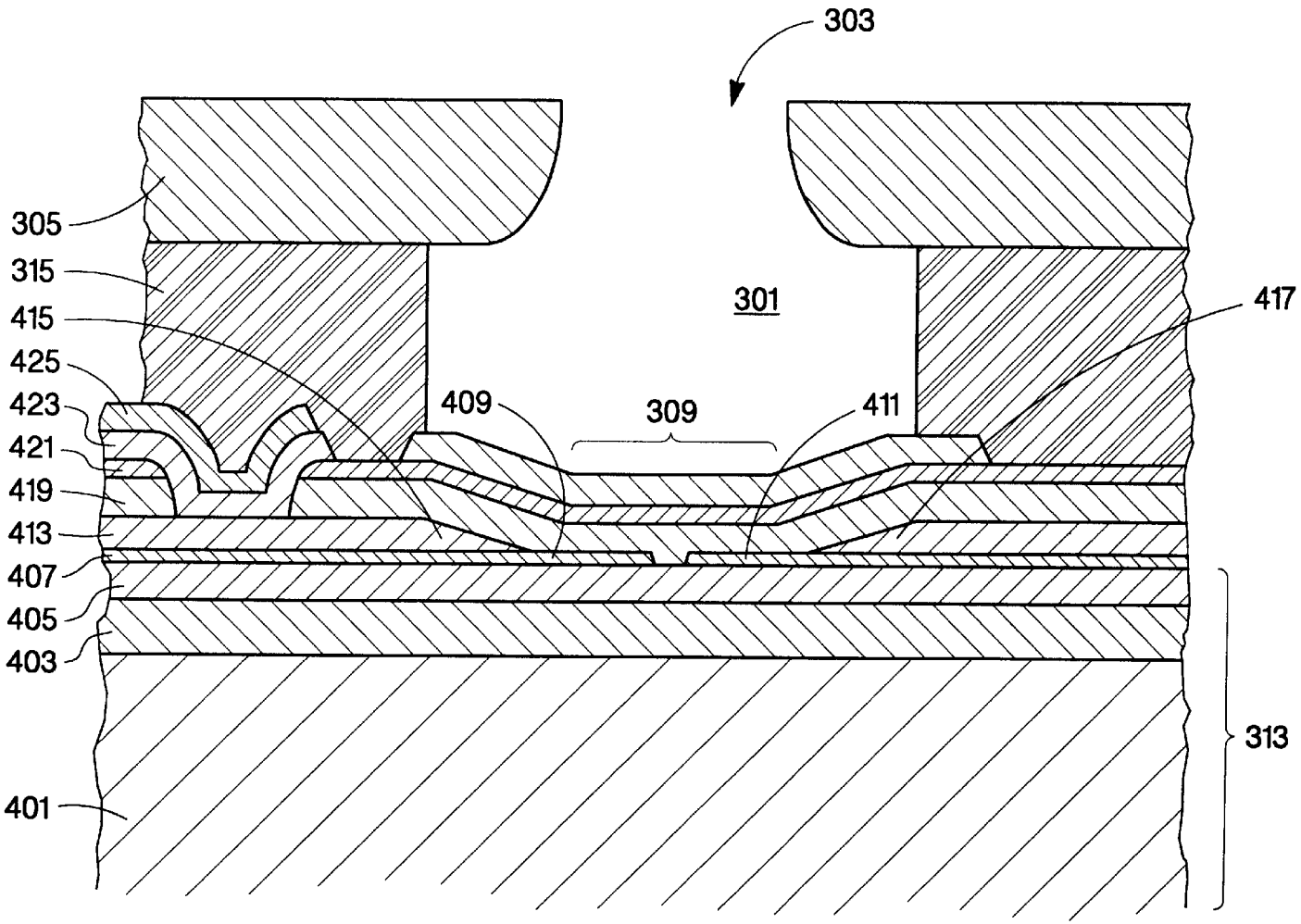
FIG. 4 is a cross sectional elevation view of the drop generator of the printhead of FIG. 3, illustrating the layers of material that form a drop generator useful in the present invention.

In FIG. 4, a cross section of the firing chamber 301 and the associated structures are shown. The substrate 313 comprises, in the preferred embodiment, a semiconductor base 401 of silicon, treated using either thermal oxidation or vapor deposition techniques to form a thin layer 403 of silicon dioxide and a thin layer 405 of phospho-silicate glass (PSG) thereon. The silicon dioxide and PSG forms an electrically insulating layer approximately 17000 Å thick upon which a subsequent layer 407 of tantalum-aluminum (TaAl) resistive material is deposited. The tantalum-aluminum layer is deposited to a thickness of approximately 900 Å to yield a resistively of approximately 30 Ω per square. In a preferred embodiment, the resistive layer is conventionally deposited using a magnetron sputtering technique and then masked and etched to create discontinuous and electrically independent areas of resistive material such as areas 409 and 411. Next, a layer 413 of aluminum-silicon-copper (Al-SiCu) alloy conductor is conventionally magnetron sputter deposited to a thickness of approximately 5000 Å atop the tantalum aluminum layer areas 409, 411 and etched to provide discontinuous and independent electrical conductors (such as conductors 415 and 417) and interconnect areas. To provide protection for the heater resistors and the connecting conductors, a composite layer of material is deposited over the upper surface of the conductor layer and resistor layer. A dual layer of passivating materials includes a first layer 419 of silicon nitride ($Si_3N_4$) in a range of 2350 Å to 2800 Å thick, which is covered by a second layer 421 of inert silicon carbide (SiC) in a range of 1000 Å to 1550 Å thick. This passivation layer (419, 421) provides both good adherence to the underlying materials and good protection against ink corrosion. It also provides electrical insulation. An area over the heater resistor 309 and its associated electrical connection is subsequently masked and a cavitation layer 423 of tantalum in a range of 2500 Å to 3500 Å thick is conventionally sputter deposited. A gold layer 425 may be selectively added to the cavitation layer in areas where electrical interconnection to the flexible conductive tape 119 (or 117) is desired. An example of semiconductor processing for thermal inkjet applications may be found in U.S. Pat. No. 4,862,197, "Process for Manufacturing Thermal Inkjet Printhead and Integrated Circuit (IC) Structures Produced Thereby." An alternative thermal inkjet semiconductor process may be found in U.S. Pat. No. 5,883,650, Thin-Film Printhead Device for an Ink-Jet Printer."

In a preferred embodiment, the sides of the firing chamber 301 and the ink feed channel are defined by a polymer barrier layer 315. This barrier layer is preferably made of an organic polymer plastic that is substantially inert to the corrosive action of ink and is applied using conventional techniques upon substrate 313 and its various protective layers. To realize a structure useful for printhead applications, the barrier layer is subsequently photolithographically defined into desired shapes and then etched. In the preferred embodiment, the barrier layer 315 has a thickness of about 15 $\mu$m after the printhead is assembled with the orifice plate 305.

The orifice plate 305 is secured to the substrate 313 by the barrier layer 315. In some print cartridges the orifice-plate 305 is constructed of nickel with plating of gold to resist the corrosive effects of the ink. In other print cartridges, the orifice plate is formed of a polyamide material that can be used as a common electrical interconnect structure. In an alternative embodiment, the orifice plate and barrier layer is integrally formed on the substrate.

It is common to electrically arrange the many heater resistors disposed on the printhead substrate into groups generally called primitives. These primitives are individually supplied electrical current in sequence from the electrical power supply located in the printer. To complete the electrical circuit, a ground, or common, return conductor returns the electrical current to the power supply. In a preferred embodiment, each heater resistor within a primitive has its own associated switch circuit such as a field effect transistor. Each switch circuit is connected to an address pad that receives signals from the printer for activating the switch circuit into a conductive state to allow the heater resistor associated with the switch circuit to be fired. In this embodiment, each address pad is connected to the switch circuit of one resistor in each primitive. When the printhead is operated, the printer cycles through the addresses such that only a single heater resistor is energized at a time for a particular primitive. However, multiple primitives can be fired simultaneously. For maximum print densities, all of the primitives may be fired simultaneously (but with a single heater resistor energized at a time for each primitive). In one such embodiment, each address line is connected to all of the primitives on the printhead. In another embodiment, each address line is only connected to some of the primitives. In a preferred embodiment, each primitive is connected to a separate primitive select line that provides power for each primitive. Each primitive select line has its own separate pad on the substrate for selective energization. Thus, the number of primitive select lines correspond to the number of primitives. When a particular heater resistor is energized the address associated with that resistor is activated to put the switch circuit associated with that particular resistor into a conducting condition that provides a low resistance path to current that would flow through the switch circuit and through the heater resistor. Then, while the switch is conducting, a high current firing pulse is applied to the primitive select line to energize the particular heater resistor. After firing, the address line is deactivated to place the switch circuit into a non-conducting state.

In previous printhead designs, a separate ground lead has been provided for each primitive. An aspect of this invention is that a single ground lead is connected to multiple primitives to reduce the number of required interconnections to the substrate. In one embodiment, at least four primitives are connected to the same ground lead. Each ground lead has at least one ground pad. When a particular heater resistor is fired, current travels from the primitive select pad, through the switch circuit and resistor, returning to the ground pad. However, if many or all of the primitives are operated simultaneously, the parasitic power dissipation in a single ground lead can be large. To reduce this effect, the heater resistor value is increased from a conventional value of about 30 to 40 Ω to about 140 Ω measured between primitive select and ground pads.

To further reduce parasitic power dissipation, multiple ground pads are connected in common with the single ground lead to reduce the resistance between grounds and primitives. These leads are preferably spaced apart on the substrate to help balance the resistance of resistors located in the center of the die versus resistors more toward the edge of the die where the ground pads are typically located.

In a preferred embodiment, a primitive consists of eighteen ink ejecting heater resistors. An electrical schematic of one primitive 501 is shown in FIG. 5. Eighteen heater resistors, R, are each connected to a conductor 503, which is a conductive metal film deposited on the substrate such as shown previously for FIG. 4. Conductor 503 is physically routed away from the heater resistors and terminated in an interconnect terminal, $PS_n$, that is conventionally interconnected with the flexible tape 117 for coupling to the power supply 217 of the printer. The heater resistors, R, are individually coupled to the drain terminal of a MOS transistor switch (for example, transistor 507) as shown in FIG. 5. The source of the transistor switches of primitive 501 are connected to the ground return conductor 509. To activate (energize) a heater resistor, the associated transistor switch must be placed in a conducting mode. This is accomplished in a preferred embodiment by applying an activation signal to the signal line of the address bus associated with the heater resistor to be energized. The activation signal biases the gate terminal of the transistor switch to put the transistor in a conducting (on) condition. Each signal line of the address bus is sequentially activated for a period of time (for example, approximately 1.4 μsec in a preferred embodiment) in order to allow an ink vapor bubble to form and eject an ink drop from the nozzle associated with the energized heater resistor. Of course, if the character or image being printed does not require an ink dot at the present location of the medium and print cartridge, the activation signal to the heater resistor is suppressed by the printer drop firing controller 215.

In a preferred embodiment, eight primitives are arrayed on either side of an elongated opening, or slot, 601 in the printhead substrate. This arrangement can be appreciated from the schematic plan view representation of the top surface of the printhead substrate shown in FIG. 6. Not shown are the orifice plate and barrier layer, which would otherwise obscure the surface of the substrate. The elongated opening 601 extends from the top surface of the substrate, upon which the heater resistors are deposited, to the bottom surface of the substrate, which is typically affixed to the body of the print cartridge and which is coupled to the supply of ink available to the print cartridge. Ink enters the printhead via the elongated opening and is distributed to each firing chamber.

Figure 7:
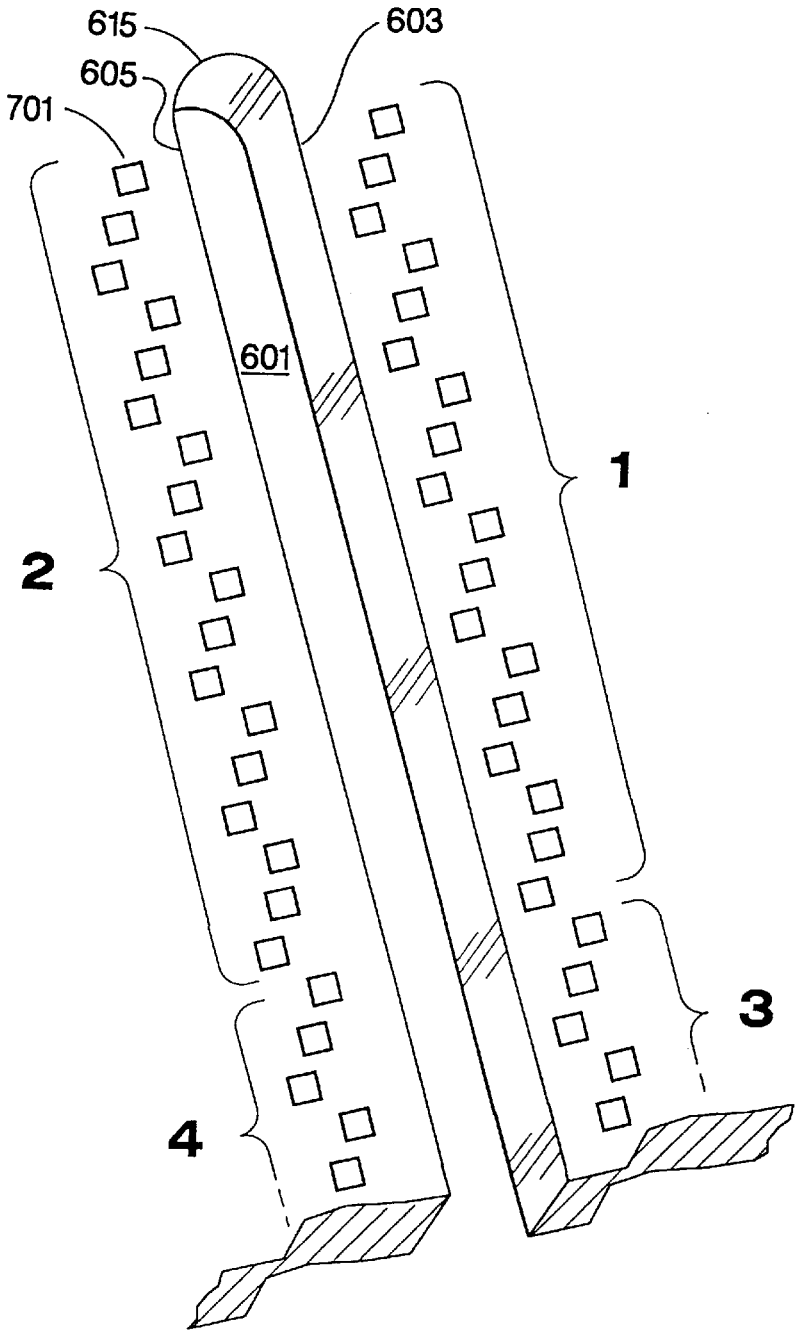
FIG. 7 is a plan view of a printhead substrate illustrating an exemplary layout of heater resistors which may be employed in the present invention.

Four primitives are disposed at one linear edge 603 of the elongated opening 601, for example primitives numbered 1, 3, 5, and 7, and having an electrical circuit 501 like that shown in FIG. 5. Four other primitives, numbered 2, 4, 6, and 8, are disposed at the other linear edge 605 of the elongated opening 601. For clarity, individual heater resistors (for example, heater resistor 701, a member of primitive number 1) are illustrated arrayed around the elongated opening 601 in the FIG. 7 view of the printhead substrate. Heater resistor members of primitive number 2 and a few of the theater resistors of primitives 3 and 4 are also shown.

Returning to FIG. 6, it can be seen that the address bus 607 with eighteen signal lines is electrically parallel coupled to each primitive so that each primitive is activated simultaneously with the sequenced activation signals applied to the address bus by the printer drop firing controller 215. The physical arrangement of the address bus conductors on the substrate are shown in generalized fashion; the actual physical orientation of the conductors may be varied as the layout requirements of the printhead demand. The primitive electrical current supply conductors (for example conductor 609, coupled to primitive number 1, 501, and input terminal PS1) are independently coupled to each primitive to couple high current electrical power from the printer power supply 217 (coupled via the flexible tape 117) to each of the primitives. Depending upon the print cartridge position relative to the medium upon which ink dots are to be deposited, the character or image to be printed, the particular color hue and intensity required, and the orientation of the particular drop generator (which will have a particular positional relationship to other drop generators), a range of no primitive to all primitives may have the high current electrical power supplied from the power supply.

It is a feature of the present invention that the ground return conductor is coupled to all eight of the primitives and utilizes two widely spaced output terminals to complete the electrical circuit to the power supply. This ground return conductor 611 is coupled to each of the primitives, which are disposed four at one edge of the elongated opening 601 and four at the other. Two terminals, G1 and G2, are located at opposite ends of the elongated opening, the ends being defined by the narrow end edges 613 and 615 that join the long parallel edges 603 and 605. Thus, the surface perimeter edge of the elongated opening is defined by the two long parallel edges 603 and 605 and end edges 613 and 615. Several advantages are gained by spacing the two return conductor terminals apart and at opposite ends of the elongated opening. Reducing the number of ground return conductors from one per primitive to an electrically shared pair for all primitives enables a closer spacing of drop ejectors - and higher DPI. Sharing the two terminals provides redundancy for the ground return for all primitives. Previously, the loss of a ground return terminal for a primitive would disable the entire primitive and practically make a print cartridge worthless; eighteen non-functioning drop ejectors yields a terrible quality of printed characters or images. A loss of one of the shared ground return terminals in a printhead employing the present invention does not disable an entire primitive.

Figure 6:
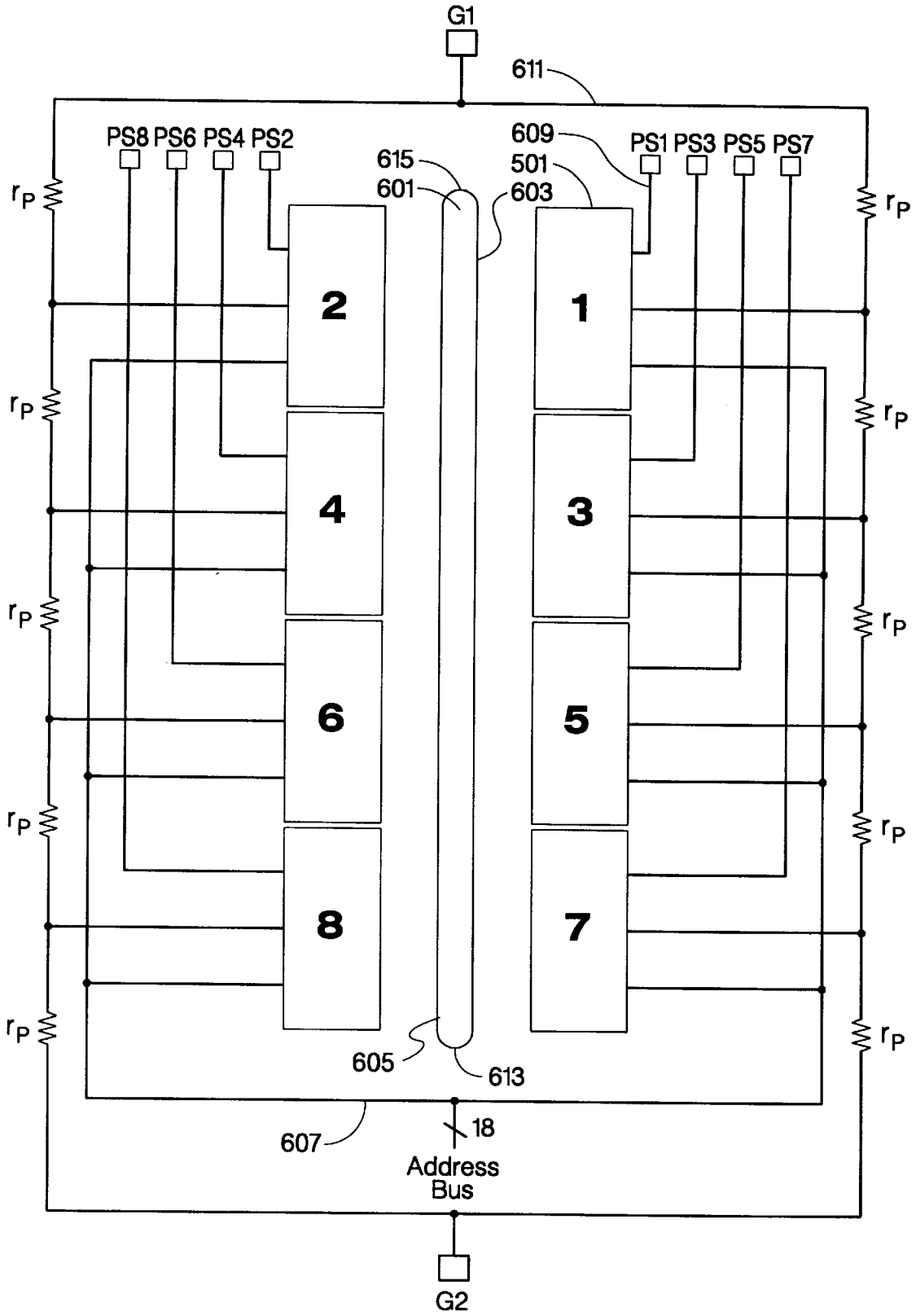
FIG. 6 is a plan view schematic representation of an eight-primitive arrangement disposed on part of a printhead substrate.

A better balancing of parasitic resistances between primitives is also achieved when two ground return terminals are shared. The parasitic resistance in sections of the ground return conductor 611 is schematically represented by $r_P$ and is physically manifested as the finite resistance in a conductive material that is not a perfect conductor. A shared ground return conductor can be idealized in sections as shown in FIG. 6. Consider the ground return conductor parasitic resistance experienced by primitives 1, 2, 7, and 8:

$$R_{P1}=(4r_P^2)/(5r_P)=(4/5)r_P$$

Then consider the ground return conductor parasitic resistance experienced by primitives 3, 4, 5, and 6:

$$R_{P2}=(6r_P^2)/(5r_P)=(6/5)r_P.$$

Unless other measures were undertaken in previous implementations, the parasitic resistance variations in independent ground return conductors could experience resistance variations of as much as 4:1 in an eight primitive design. This variation can be contrasted to the more benign 2:3 variation found when employing the present invention. Of course, it should be recognized that the actual parasitic resistance are dependent upon substrate layout and other factors. Moreover, it is within the scope of the present invention that more than two ground return terminals may be shared by all the primitives. Furthermore, it is likely that more than eight primitives will be used for larger printhead applications.

Figure 8:
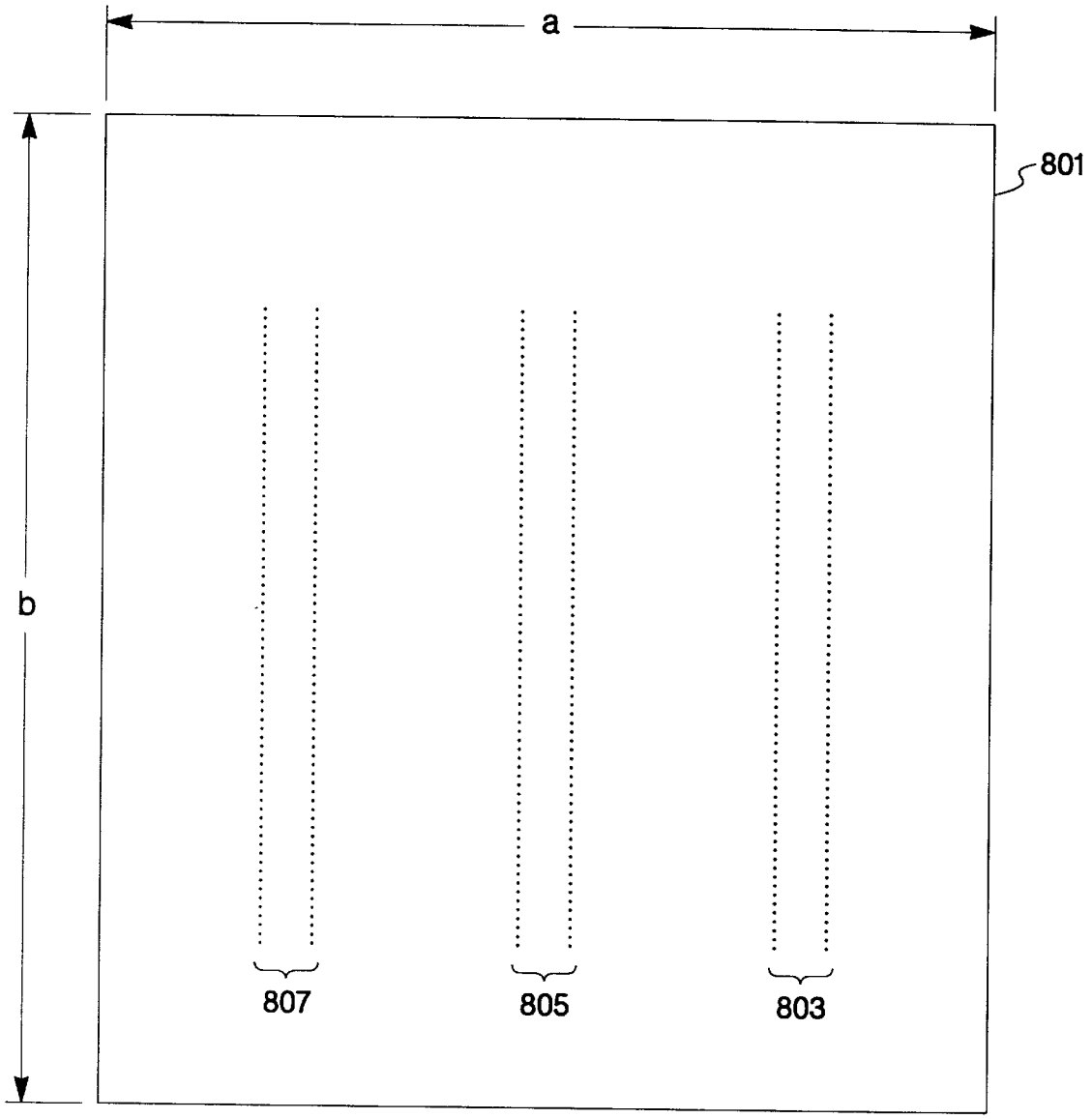
FIG. 8 is a plan view of the exterior surface of a printhead orifice plate which may employ the present invention.

In a three color (e.g., cyan, yellow, and magenta) print cartridge, three elongated openings are utilized to supply each of the three colors. Three independent sets of eight primitives each, one for each color, are arranged on the printhead. Each primitive, in a preferred embodiment, utilizes the primitive and elongated opening design described above. A preferred arrangement is illustrated in the plan view of an orifice plate of FIG. 8. The orifice plate outer surface 801 has a cyan nozzle set 803, a cyan nozzle set 805, and a magenta nozzle set 807.

In a preferred embodiment, as many as 432 drop generators are anticipated to be arranged on a printhead in the three color groups of 144 drop generators each although more or fewer can be used. The arrangement is such that a 1200 DPI resolution in the scan direction, X, is achieved. The dimensions of the semiconductor substrate to which the orifice plate is secured are shown as a width dimension, a, of nominally 7.9 mm (along the X, scan, direction) and a height dimension, b, of nominally 8.7 mm. A single color, e.g. black, printhead may employ the present invention but with different dimensions, number of primitives, and number of ink ejectors.

Thus, the number of conductors employed in a high resolution printhead is reduced without sacrificing reliability by sharing a ground return conductor with redundant output terminals.

We claim:

1. A printhead for an inkjet printer, comprising:

a substrate;

a plurality of heater resistors disposed on said substrate and electrically arranged into a first group and a second group;

a first electrical conductor disposed on said substrate, coupled to each heater resistor in said first group, and terminating in a first terminal disposed on said substrate whereby electrical current is sourced to each heater resistor in said first group;

a second electrical conductor disposed on said substrate, coupled to each heater resistor in said second group, and terminating in a second terminal disposed on said substrate whereby electrical current is sourced to each heater resistor in said second group; and a third electrical conductor disposed on said substrate, coupled to each heater resistor in both said first group and said second group, and terminating in third and fourth terminals disposed spaced apart from each other on said substrate whereby electrical current is returned to complete an electrical circuit.

2. A printhead in accordance with claim 1 further comprising an address bus coupled to both said first group and said second group and conveying an individual resistor select signal to select one heater resistor in each said first group and said second group for activation.

3. A printhead in accordance with claim 2 wherein said address bus further comprises a plurality of signal lines.

4. A printhead in accordance with claim 3 further comprising a plurality of switches, each switch of said plurality of switches corresponding to one heater resistor of said plurality of heater resistors, and each switch of said first group coupled to a corresponding one of said plurality of signal lines.

5. A printhead in accordance with claim 1 wherein said first group of heater resistors further comprises resistors physically disposed essentially in a column.

6. A printhead in accordance with claim 1 wherein said substrate further comprises a first surface upon which said plurality of heater resistors is disposed and a second surface, the printhead further comprising an elongated opening extending from said first surface through said substrate to said second surface and having a first linear edge at said first surface parallel to a second linear edge at said first surface, said first linear edge joined to said second linear edge by first and second end edges to complete a peripheral definition of said elongated opening.

7. A printhead in accordance with claim 6 wherein said first group of heater resistors is disposed at said first edge and said second group of heater resistors is disposed at said second edge.

8. A printhead in accordance with claim 6 wherein said first group of heater resistors and said second group of heater resistors are disposed at said first edge.

9. A printhead in accordance with claim 6 wherein said third terminal is disposed approximate said first end edge of said elongated opening and said fourth terminal is disposed approximate said second end edge of said elongated opening.

10. A print cartridge for an inkjet print apparatus, comprising:

a cartridge body;

an ink storage reservoir disposed within said cartridge body;

an electrical interconnect circuit affixed to said cartridge body;

a printhead fluidically coupled to said ink storage reservoir and electrically coupled to said electrical interconnect circuit whereby ink drops are ejected from said printhead, said printhead comprising:

a substrate;

a plurality of heater resistors disposed on said substrate and electrically arranged into at least eight groups;

at least eight electrical conductors disposed on said substrate, each electrical conductor of said at least eight electrical conductors coupled to each resistor of a respective one of said at least eight groups, and each conductor of said at least eight electrical conductors terminating in a respective one of at least eight terminals disposed on said substrate and connecting to said electrical interconnect circuit whereby electrical current is sourced to each heater resistor in each of said at least eight groups; and a return electrical conductor disposed on said substrate, coupled to each heater resistor in said at least eight groups, and terminating in two output terminals disposed spaced apart from each other on said substrate and connecting to said electrical interconnect circuit whereby electrical current is returned to complete an electrical circuit.

11. A method of manufacture of a printhead for an inkjet printer comprising the steps of:

disposing a plurality of heater resistors on a substrate;

electrically arranging said plurality of heater resistors into a first group and a second group;

disposing a first electrical conductor on said substrate, coupling said first electrical conductor to each heater resistor in said first group, and terminating said first electrical conductor in a first terminal on said substrate whereby electrical current is sourced to each heater resistor in said first group;

disposing a second electrical conductor on said substrate, coupling said second electrical conductor to each heater resistor in said second group, and terminating said second electrical conductor in a second terminal on said substrate whereby electrical current is sourced to each heater resistor in said second group; and disposing a third electrical conductor on said substrate, coupling said third electrical conductor to each heater resistor in both said first group and said second group, and terminating said third electrical conductor in third and fourth terminals disposed spaced apart from each other on said substrate whereby electrical current is returned to complete an electrical circuit.

12. A method in accordance with the method of claim 11 further comprising the step of coupling an address bus to both said first group and said second group to convey an individual resistor select signal to one heater resistor in each said first group and said second group for activation.

13. A method in accordance with the method of claim 12 further comprising the steps of:

coupling said address bus to a plurality of switches; and coupling at least one switch of said plurality of switches to a corresponding one heater resistor of said plurality of heater resistors.

14. A method in accordance with the method of claim 11 wherein said step of electrically arranging said plurality of heater resistors further comprises the step of physically disposing said heater resistors essentially in a column.

15. A method in accordance with the method of claim 11 further comprising the steps of:

extending an elongated opening extending from a first surface of said substrate upon which said plurality of heater resistors is disposed through said substrate to a second surface of said substrate; and defining a first linear edge at said first surface parallel to a second linear edge at said first surface and joining said first linear edge to said second linear edge by first and second end edges to complete a periphery of said elongated opening.

16. A method in accordance with the method of claim 15 further comprising the steps of disposing said first group of heater resistors at said first edge and disposing said second group of heater resistors at said second edge.

17. A method in accordance with the method of claim 15 further comprising the step of disposing said first group of heater resistors and said second group of heater resistors at said first edge.

18. A method in accordance with the method of claim 15 further comprising the steps of disposing said third terminal proximate said first end edge of said elongated opening and disposing said fourth terminal proximate said second end edge of said elongated opening.

19. A method of operating a print cartridge printhead in an inkjet printing apparatus comprising the steps of:

applying an electrical current to a first terminal of a first electrical conductor that is coupled to each heater resistor arranged in a first group of a plurality of heater resistors on a printhead substrate;

after said first applying step, applying an electrical current to a second terminal of a second electrical conductor that is coupled to each heater resistor arranged in a second group of said plurality of heater resistors on said printhead substrate; and returning said electrical current applied to a first terminal and said electrical current applied to a second terminal via third and fourth electrically common terminals disposed spaced apart from each other on said printhead substrate and coupled to a third electrical conductor coupled to each heater resistor in both said first group and said second group of heater resistors.

20. A method of operating a print cartridge printhead in accordance with claim 19 further comprising the step of applying an activation signal to said first group of said plurality of heater resistors and to said second group of said plurality of heater resistors to select at least one heater resistor in each said first group and said second group for activation.

* * * * *

UNITED STATES PATENT AND TRADEMARK OFFICE

CERTIFICATE OF CORRECTION

PATENT NO. : 6,234,598 B1
DATED : May 22, 2001
INVENTOR(S) : Torgerson et al.

It is certified that error appears in the above-identified patent and that said Letters Patent is hereby corrected as shown below:

Column 11,
Lines 17 and 19, “approximate” should read -- proximate --.

Signed and Sealed this

Sixth Day of May, 2003

JAMES E. ROGAN
*Director of the United States Patent and Trademark Office*